United States Patent [19]

Strachan

[11] Patent Number: 4,527,722

[45] Date of Patent: Jul. 9, 1985

[54] MULTIPLE UNIT TAPE DISPENSER

[75] Inventor: Gray Strachan, Beverly Shores, Ind.

[73] Assignee: Stranco Products, Inc., Michigan City, Ind.

[21] Appl. No.: 520,062

[22] Filed: Aug. 3, 1983

[51] Int. Cl.[3] ..... B26F 3/02; B65D 85/671

[52] U.S. Cl. ..... 225/106; 225/25; 225/34; 242/55.3

[58] Field of Search ..... 225/34, 37, 38, 25, 225/26, 106; 206/394, 411; 242/55.3

[56] References Cited

U.S. PATENT DOCUMENTS

| | | | |
|---|---|---|---|
| 1,268,222 | 6/1918 | Dwyer | 242/55.3 |
| 3,144,184 | 8/1964 | Yerkes | 225/26 |
| 3,291,299 | 12/1966 | Minnotte, Jr. | 225/106 |
| 3,502,252 | 3/1970 | Mariani | 225/33 |
| 3,514,016 | 5/1970 | Hackney | 242/55.3 X |
| 4,252,258 | 2/1981 | Plummer | 225/34 X |
| 4,262,835 | 4/1981 | Wrobel | 225/25 |

*Primary Examiner*—Frank T. Yost
*Attorney, Agent, or Firm*—Lee, Smith & Zickert

[57] ABSTRACT

A multiple unit tape dispenser having a plurality of juxtaposed, generally hollow plastic housings, each of which contains a roll of tape. Each housing has a front dispenser wall which has a slot across the width of the housing which is dimensioned to permit withdrawal of tape longitudinally from the roll of tape within the housing. A tape support shelf extending outwardly from the front dispenser wall of each housing is situated adjacent the slot and is positioned to underly a length of tape when withdrawn from the housing. To aid removal of the tape, the under side of the shelf is provided with a series of spaced, lateral ribs. A spindle is situated within each housing for mounting of the roll of tape. Adjacent housings are attached to one another via a pin-and-aperture arrangement and an extension of each spindle which engages a socket in an adjacent housing. An end plate is shaped to cover the otherwise open side of a housing of the dispenser.

20 Claims, 9 Drawing Figures

Fig. 4.
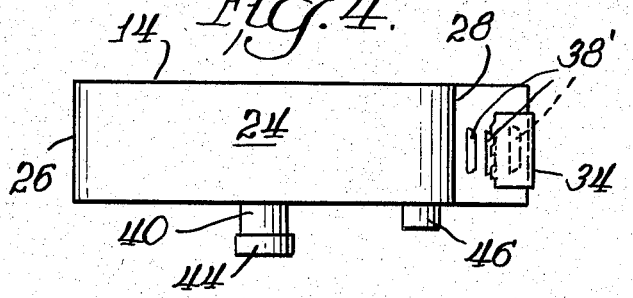
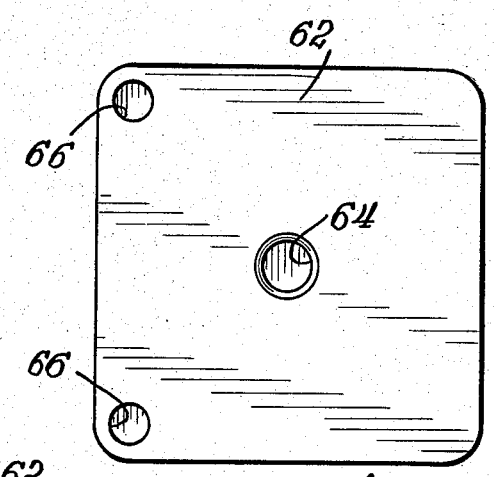
Fig. 6.
Fig. 7.
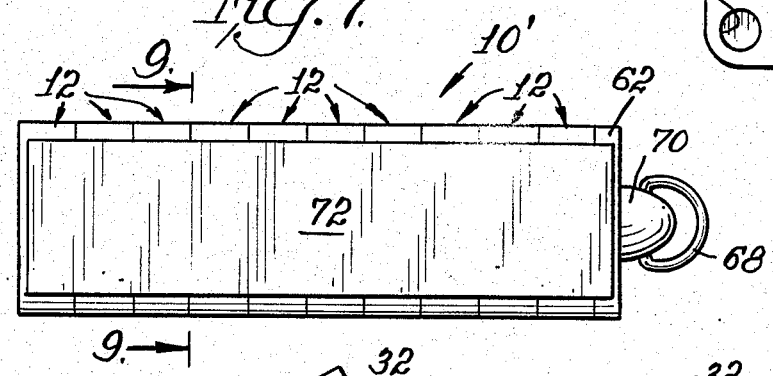
Fig. 8
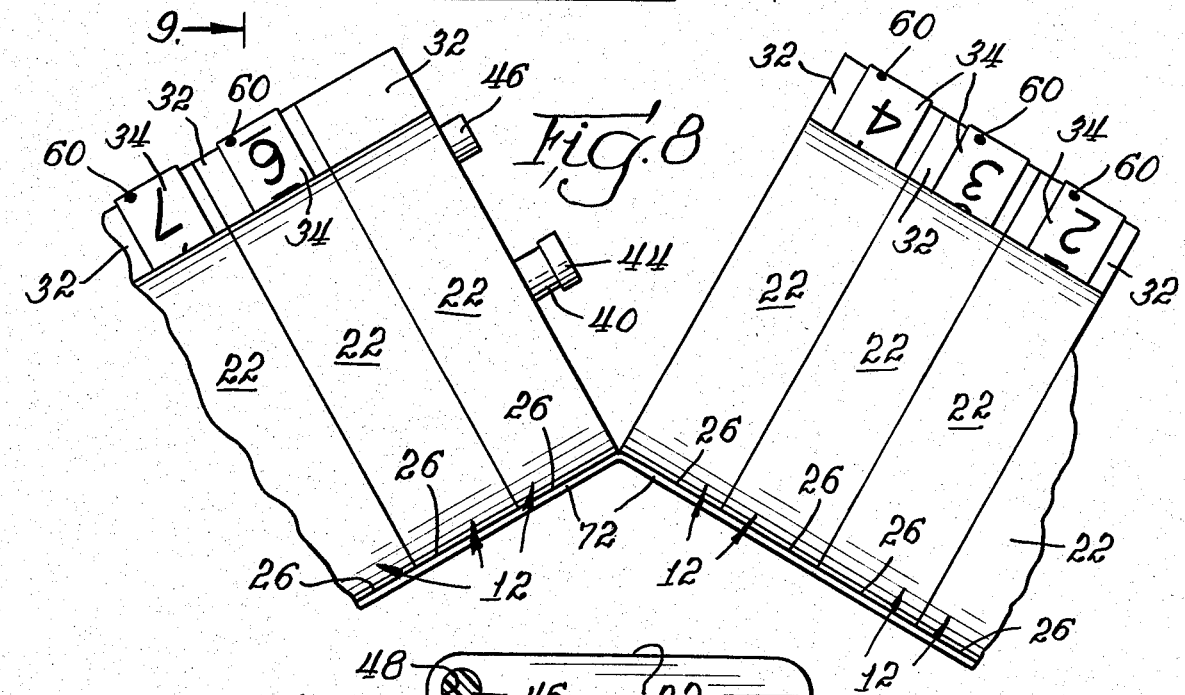
Fig. 9.
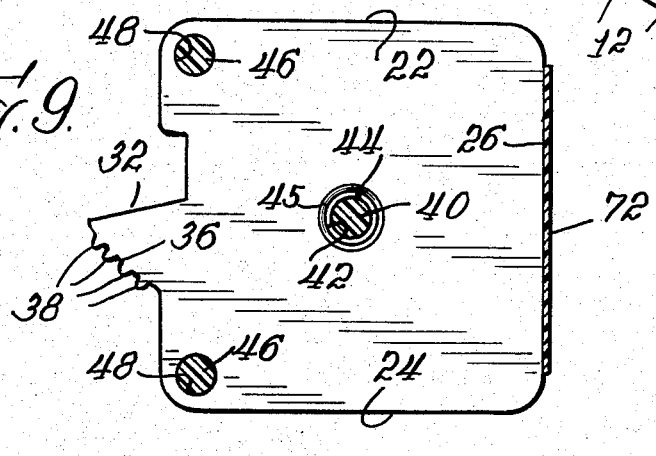

MULTIPLE UNIT TAPE DISPENSER

BACKGROUND OF THE INVENTION

This invention relates to tape dispensers and in particular a multiple unit tape dispenser useful for dispening lengths of tape for marking electrical wires and other objects.

Tape dispensers of the nature of the present invention are used for marking electrical wires when a number of similar wires are to be contained within a conduit, electrical trench duct or other device for carrying a series of wires. To discern between the wires, each wire is individually marked with a unique number by affixing directly to the wire a tape or tapes bearing a number unique to the wire.

U.S. Pat. No. 4,262,835 discloses a tape dispenser for carrying ten rolls of tape (each one representing a different digit) for marking wires. Due to the nature of the structure of the dispenser of this patent, ten individual and identical compartments must be supplied in the dispenser, each compartment holding an individual roll of tape. While the dispenser is quite functional if ten rolls of tape are used, if fewer then ten rolls of tape are needed, certain of the tape compartments are left vacant since the individual compartments are not modular and therefore cannot be detached from the remainder of the tape dispenser.

Also as set forth in U.S. Pat. No. 4,262,835, the rolls of tape are installed in the tape compartments in the opposite orientation than what is normally considered to be correct installation within a tape dispenser so that the tape adheres to a hinged door as it is opened. The tape therefore must be peeled away from the door in order to be withdrawn from the tape roll. This can prove to be a nuisance since often, it is difficult for the user to engage the end of the tape to remove it from the hinged door.

SUMMARY OF THE INVENTION

The tape dispenser of the invention comprises a generally hollow plastic housing having one closed side and one side open sufficiently to permit insertion of a roll of tape within the hollow plastic housing. The housing has a front dispenser wall having a slot substantially across the width of the housing which is dimensioned to permit withdrawal of tape longitudinally from a roll of tape within the housing. A tape support shelf extends outwardly from the front dispenser wall adjacent the slot and is positioned to underlie a length of tape when withdrawn from the housing. A spindle is located within the housing and is attached to the closed side for mounting a roll of tape within the housing. The spindle extends across the width of the housing.

The dispenser includes means for attaching one housing axially to a second housing. The attaching means includes one connection element comprising a pin protruding from one side of the housing and a corresponding pin-receptive aperture in the other side of the housing. Two such pins and apertures are employed in the preferred embodiments.

In accordance with the preferred embodiments of the invention, the shelf extends downwardly at an oblique angle to the front dispenser wall. The shelf includes means for aiding removal of the tape from the shelf in the form of a series of spaced lateral ribs beneath the shelf. In accordance with one embodiment of the invention, the length of the ribs is substantially equal to the width of the shelf. In accordance with the other embodiment of the invention, the length of the ribs is less than the width of the tape dispensed from the housing. In either embodiment, the presence of the ribs permits the user to easily grasp the free end of the tape.

To further aid in attaching one housing to another, each spindle includes an extension protruding outwardly from the open side of the housing. A corresponding socket is formed in the closed side of the housing in axial alignment with the spindle. The extension includes an expanded portion which is shaped to frictionally engage the socket when inserted into the socket. It is preferred that the aperture have a conical mouth to guide initial insertion of the extension. The housings, in essence, therefore snap together.

Since one side of each housing is open, when either a single housing or a plurality of snapped-together housings are employed as a dispenser, an end plate is used to cover the open side of the end of the tape dispenser. The end plate includes a socket which is shaped to clamp to the extension of a spindle to retain the end plate in place.

A roll of tape is removably mounted on the spindle. The tape comprises a strip of pressure-sensitive adhesive tape wound onto a tape core and which is situated within the housing to be withdrawn longitudinally through the slot. The tape includes a plurality of longitudinally spaced rows of lateral perforations for severance of selected portions of the tape from the strip. In accordance with the preferred embodiment of the invention, the perforations are in pairs of immediately adjacent rows with separate pairs being spaced a predetermined distance depending on the desired length of the portions of tape to be severed. The perforations of each row of the pair of rows are staggered relative to one another in order to enhance the rupture of the tape at the perforations. Guide indicia is provided on the tape strip associated with each of the rows of perforations for indicating the extent of withdrawal of the tape strip through the slot necessary for severance of the tape at the associated row of perforations.

Typically, a plurality of the housings are used to form a tape dispenser, the housings being joined in a juxtaposed relationship. In one embodiment of the invention, the housings are joined solely by the extensions of the spindles and by the connection elements. In a second embodiment of the invention, a flexible tape is employed to hingedly join adjacent housings.

BRIEF DESCRIPTION OF THE DRAWINGS

The invention is described in greater detail in the following description of the preferred embodiments, taken in conjunction with the drawings, in which:

FIG. 4 is a bottom plan view of the tape dispenser of FIG. 3, FIG. 6 is an inside elevational illustration of an end plate for a tape dispenser consisting of a single housing or plurality of juxtaposed housings, FIG. 7 is a rear elevational illustration of a second embodiment of the invention having a flexible hinge strip interconnecting the juxtaposed housings of the tape dispenser, FIG. 8 is an enlarged top plan view of the dispenser of FIG. 7, with portions removed and showing the hinging of the plastic strip between adjacent housings, and FIG. 9 is an enlarged cross-sectional illustration taken along lines 9—9 of FIG. 7.

DESCRIPTION OF EXAMPLES EMBODYING BEST MODE OF THE INVENTION

Figure 1:
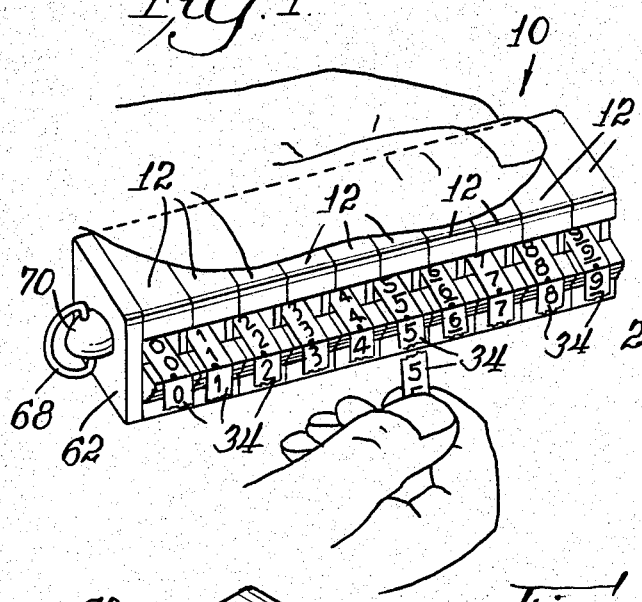
FIG. 1 is a perspective view of a tape dispenser comprising a multiplicity of tape housings according to the invention joined in a juxtaposed relationship and showing the manual severence of a portion of a tape strip after being withdrawn from a housing.
Figure 3:
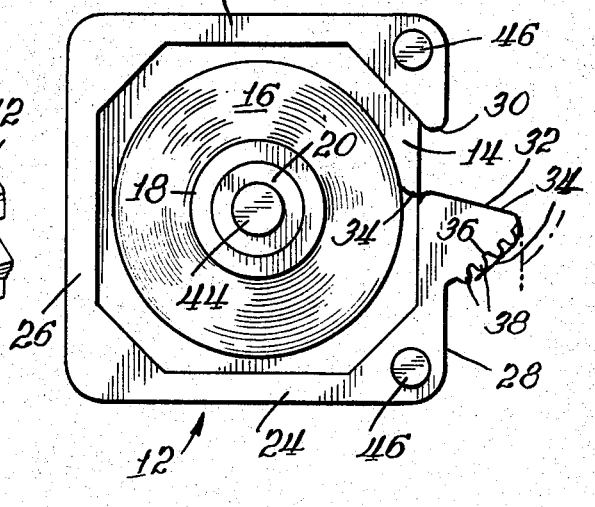
FIG. 3 is an enlarged side elevational illustration of a tape dispenser module according to the invention.
Figure 2:
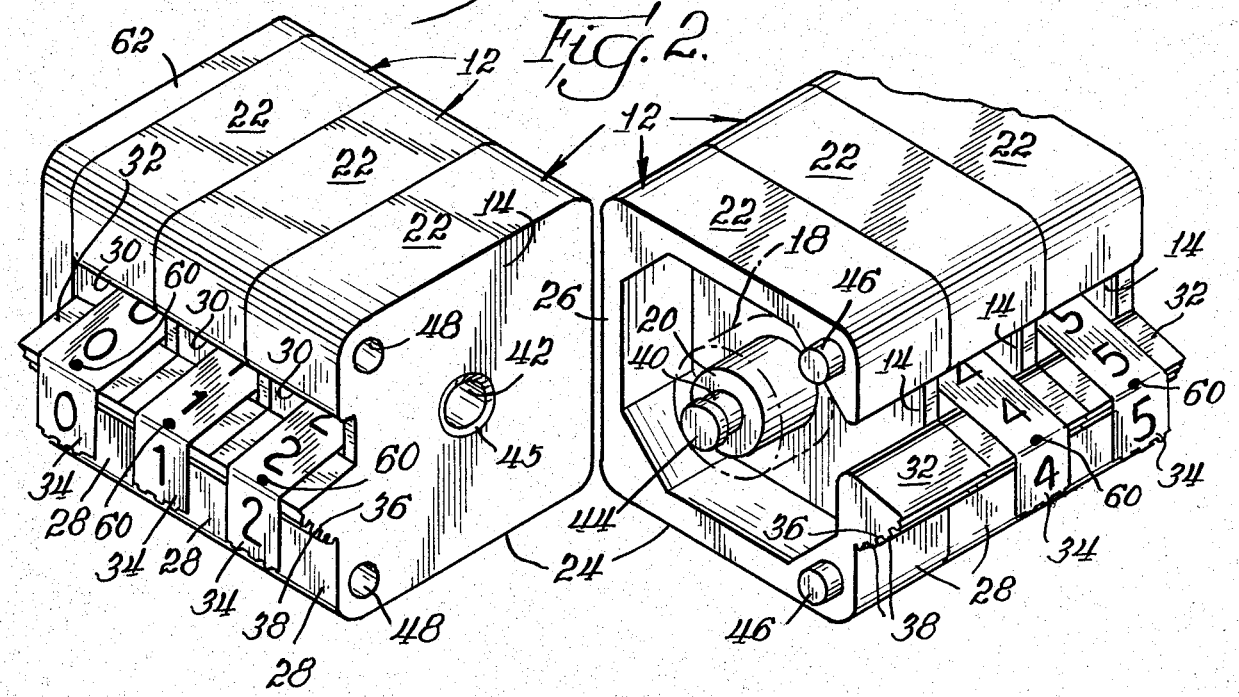
FIG. 2 is an enlarged perspective view of a tape dispenser comprising a multiple collection of juxtaposed housings, and further showing the interior of one of the housings (with its tape roll removed) and the means by which adjacent houses are secured to one another.

FIGS. 1 through 4 illustrate a first embodiment of a tape dispenser according to the invention, which is shown generally at 10 in the drawing figures. The tape dispenser 10 includes a series of generally hollow, plastic housings 12, each of which has a closed side 14 and an opposite side which is open sufficiently to permit insertion of a roll of tape 16 within the hollow plastic housing 12. As shown in FIGS. 2 and 3, the roll of tape 16 is mounted with its hub 18 on a spindle 20 which extends across the width of the housing 12.

Each housing 12 has a closed top wall 22, a closed bottom wall 24 and a closed rear wall 26. Each housing 12 also has a front wall 28 having a slot 30 extending across the width of the housing. The slot 30 is dimensioned to permit withdrawal of tape longitudinally from a roll of tape 16 when installed within a housing 12.

A tape support shelf 32 extends outwardly from the front wall 28 adjacent the slot 30. The shelf 32 is positioned to underlie a length of the tape 34 when it is withdrawn from the roll of tape 16 within the housing 12. As best shown in FIG. 3, the shelf 32 extends downwardly at an oblique angle to the front wall 28 to aid in separating a length of the tape 34, as described in greater detail below.

Often, since the tape 34 is an adhesive-type tape, the end portion of the tape will adhere to the under side of shelf 32, creating difficulty to the user to lift and grasp the end of the tape when so adhering. Since a length of tape 34 normally is separated with a remaining part of the tape overhanging the support shelf 32, the illustrated extended shelf support portion 36 beneath the shelf 32 is provided with a series of spaced lateral ribs 38 for limiting the extent of adhesion and thus aiding removal of tape adhering thereto. Even if the tape 34 should adhere to the crests of ribs 38 (FIG. 3), because of the spacing between the ribs 38 the user may readily grasp the end of the tape 34, possibly by first lifting an edge to remove it from the ribs 38 and then from the shelf 32, permitting withdrawal of another length of tape 34 from the roll of tape 16.

The spaced lateral ribs 38 are shown in FIGS. 2 and 3 as extending the entire width of the extended portion 36 below the support shelf 32. In FIG. 4, spaced lateral ribs 38′ are shown which extend less than the width of the extended portion 36 as an alternative means to aid removal of any tape 34 which may adhere to the under side of shelf 32.

In the embodiment of FIGS. 1 through 4, one housing 12 is attached axially to a second housing 12 by two means. First, each housing 12 includes an extension 40 of the spindle 20 protruding from the open side of the housing 12 and a corresponding socket 42 formed in the closed side 14 in axial alignment with the spindle 20. The extension 40 includes an expanded head portion 44 which is shaped to frictionally engage a socket 42 when inserted therewithin. Thus, the outer diameter of the expanded portion 44 is equal to or very slightly larger than the internal diameter of the socket 42. Since the material of the housing 12 and its integral spindle 20 and extension 40 is preferrably plastic, the size of the expanded portion assures that it will be force-fitted into the socket 42, and thus adjacent housings 12 will essentially snap together.

To assist and guide initial insertion of the expanded portion 44 into the socket 42, the socket 42 has a conically-tapered mouth 45. The brink of the mouth 45 is wider than the diameter of the expanded portion 44 and quickly tapers to the diameter of the socket 42. The depth of the mouth 45 is relatively shallow so that the expanded portion 44 passes beyond the mouth 45 when fully inserted within the socket 42.

In addition of the attaching of adjacent housings 12 by means of the socket 42 and extension 40, each housing 12 also includes a pair of pins 46 protruding from the open side thereof and a corresponding pair of pin-receptive apertures 48 formed in the closed side 14. The pins 46 and apertures 48 serve to properly align adjacent housings 12 and may, if desired, be formed such that the pins 46 frictionally engage the apertures 48. Ordinarily, frictional engagement of the pins 46 within the apertures 48 is unnecessary so long as the expanded portion 44 of the extension 40 so engages the mating socket 42.

As shown in FIG. 4, the extension 40 including the expanded portion 44 protrudes outwardly from the housing 12 a greater distance then the pins 46. Thus, during assembly of adjacent housings 12, the expanded portion 44 first enters the socket 42 before the pins 46 encounter their respective apertures 48. This eases assembly, since the pins 46 need not be aligned with their respective apertures 48 until the expanded portion 44 is partially inserted within the socket 42.

Figure 5:
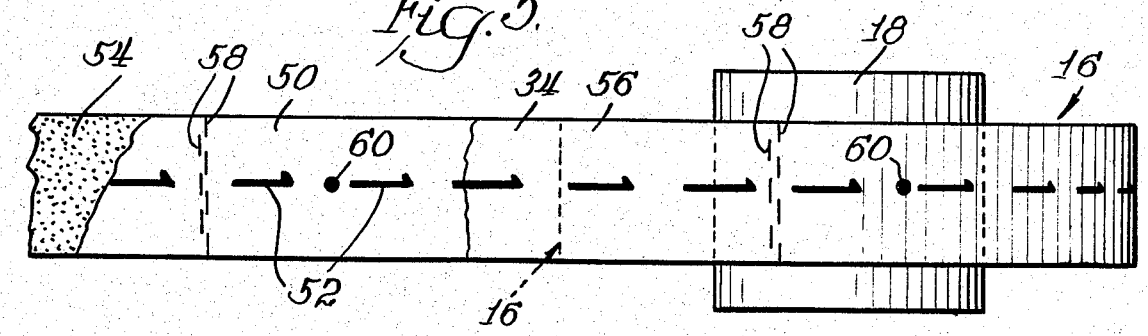
FIG. 5 is an enlarged view of one roll of tape with portions broken away in series to show the various constituents of the tape.

FIG. 5 illustrates a typical roll of tape 16 which may be installed in one of the hollow housings 12. As illustrated, the roll of tape 16 includes a length of tape 34 which is wound upon the hub 18. The width of the hub 18 is gaged to be equal to or slightly less than than the width of the hollow housing 12 so that the hub 18 does not travel axially on the spindle 20. The width of the tape 34 is slightly less than the width of the hub 18 so that the tape 34 may be readily withdrawn from the housing 12 without interference with housing structure.

The tape 34 is normally three layers, a body 50 having printed identifying indicia 52 thereon, an adhesive layer 54, and a transparent release 56 coating the body 50 to assure that the adhesive 54 does not unduly adhere thereto when unrolled from the roll of tape 16. The tape 34 includes a plurality of longitudinally spaced rows of lateral scores or perforations 58 for the separation of desired portions of the tape. While a single row of perforations 58 at each severance location may be adequate for separation, the applicant has found that including a pair of parallel rows of perforations 58 at each severance location, with the perforations 58 of each row being staggered relative to one another, helps insure that severance of the tape 34 occurs when and where desired.

As shown in the drawings, the tape 34 is normally severed while leaving a portion thereof overhanging the shelf 32. Leaving the overhanging portion of the tape 34 as shown permits the user to more readily grasp the end of the tape 34 for future withdrawal. Each roll of tape 16 is provided with guide indicia 60 on the tape 34 in the form of a dot a slight distance upstream from each of the perforations 58. As best shown in FIGS. 1 and 2, a desired length of tape 34 is withdrawn from a housing 12 until the guide indicia 60 is in alignment with the outer edge of the shelf 32. Pulling downwardly on the tape causes the tape to engage and stick to the top surface of the shelf 32 and the tape to then separate at the perforations 58 leaving a portion of the tape between the indicia 60 and adjacent perforations 58 overhanging the edge of the shelf 32 for later grasping by the user. The slope of the top surface of shelf 32 is such that it is substantially parallel to the tape passing over it as the tape is withdrawn from the roll.

As is evident, since the housing 12 has one open side, when a series of housings 12 are joined in a juxtaposed manner, one of the end-most housings 12 (the left-most housing 12 in FIG. 1) must include an end plate 62 to assure that the roll of tape 16 contained therewithin does not fall out during use and to provide a finished unit. The end plate 62 attaches to the expanded portion 44 of the extension 40 of the end-most housing 12 and also engages the pins 46 of the end-most housing 12 for alignment purposes. As shown in FIG. 6, the end plate 62 includes a socket 64 for engaging the expanded portion 44, and a pair of apertures 66 for engaging the pins 46. The plate 62 also include ring 68 attached to a post 70 which is either affixed to the end plate 62 or which is an integral part of the end plate 62. The ring 68 permits the user to strap, tie or otherwise tether a dispenser 10 to his clothing or another object to avoid loss of the dispenser.

FIGS. 7 through 9 illustrate a second embodiment of a dispenser 10' according to the invention. The dispenser 10' is practically identical to the dispenser 10 of FIGS. 1 through 6 and therefore like elements bear the same reference numerals and will not be discussed further. The only difference is the inclusion of a flexible strip 72 which is adhesively secured to the rear wall 26 of each of the housings 12 of the dispenser 10' and to the end plate 62, as shown. The strip 72, which is a plastic material coated with a pressure-sensitive adhesive, joins the adjacent housings 12 in a hinged manner (FIG. 8) which permits insertion and removal of rolls of tapes 16 into the respective housings 12, but prevents complete detachment of one housing 12 from the adjacent housing 12. While normally the strip 72 is unnecessary due to the frictional engagement of each expanded portion 44 within its associated socket 42, the strip 72 can be used at any time when the detachable design of the housings 12 is found to be undependable or undesired for any reason. As is evident, the flexible strip 72 need not extend the entire length of the dispenser 10', depending on the requirements of the person using the dispenser 10'.

Due to the modular nature of a dispenser 10 composed of a series of housings 12, the dispenser 10 is not required to be composed of any particular number of the housings 12. Although, normally ten housings 12 will be employed, each housing carrying a roll of tape 16 having printed thereon a different one of the digits 0 through 9, any number of the housings 12 can be connected axially together to form a dispenser 10.

Modifications can be made to the invention as would be apparent to one skilled in the art. For example, although a pair of pins 46 and corresponding apertures 48 are formed in each of the housings 12, it is apparent that the number of pins 46 and apertures 48 may either be reduced or increased, as required. In addition, the extension 40 of the spindle 20 is shown as having a significantly smaller diameter than the spindle 20. As is apparent, the extension 40 may be a same-diameter extension of the spindle 20 with the socket 42 being shaped accordingly to accommodate the diameter of the extension 40. In such a situation, the expanded portion 44 would be superfluous and therefore unneeded. Various changes can be made to the invention without departing from the spirit thereof or scope of the following claims.

What is claimed is:

1. A tape dispenser comprising:

a. a generally hollow plastic housing having one closed side and one side open sufficiently to permit insertion of a roll of tape within the hollow plastic housing, b. a front dispenser wall having a slot formed across the width of said housing, said slot being dimensioned to permit withdrawal of tape longitudinally from a roll of tape within said housing, c. a tape support shelf extending outwardly from said front dispenser wall adjacent said slot, said shelf being positioned to underlie a length of tape when withdrawn from said housing, d. a spindle within said housing and attached to said closed side for mounting of a roll of tape within said housing, said spindle extending across the width of said housing, and e. means for attaching one housing axially to a second housing, said attaching means including an extension of said spindle protruding from one side of said housing and a corresponding socket in the other side of said housing for receiving said extension.

2. A tape dispenser according to claim 1 including closed top, bottom and rear dispenser walls attached to said closed side.

3. A tape dispenser according to claim 1 in which said shelf further extends downwardly from said front dispenser wall at an oblique angle to said front dispenser wall.

4. A tape dispenser according to claim 1 in which said shelf includes means for aiding removal of tape adhering to said shelf.

5. A tape dispenser according to claim 4 in which said aiding means comprises a series of spaced lateral ribs beneath said shelf.

6. A tape dispenser according to claim 5 in which the length of each of said ribs is substantially equal to the width of said shelf.

7. A tape dispenser according to claim 5 in which the length of each of said ribs is less than the width of the tape to be dispensed.

8. A tape dispenser according to claim 1 in which said extension of said spindle protrudes outwardly of said open side and said socket is formed in said closed side in axial alignment with said spindle.

9. A tape dispenser according to claim 8 in which said extension includes an expanded portion shaped to frictionally engage a said socket when inserted within said socket.

10. A tape dispenser according to claim 1 including an end plate shaped to cover said open side.

11. A tape dispenser according to claim 10 in which said extension protrudes outwardly of said open side and said end plate includes a socket shaped to clamp said extension to retain said end plate against said open side.

12. A tape dispenser according to claim 1 including a roll of tape removably mounted on said spindle, said roll of tape comprising a strip of pressure sensitive adhesive tape wound onto a tape hub and situated to be withdrawn through said slot.

13. A tape dispenser according to claim 12 in which said tape strip includes a plurality of longitudinally spaced rows of lateral perforations for severance of portions of said tape strip.

14. A tape dispenser according to claim 13 including spaced adjacent parallel pairs of rows, the perforations of each row of said pair of rows being staggered relative to one another.

15. A tape dispenser according to claim 13 including guide indicia on said tape strip associated with each said row of perforations for indicating the extent of withdrawal of said tape strip through said slot necessary for severance along said associated row of perforations.

16. A tape dispenser according to claim 1 including a plurality of said housings in juxtaposed relationship, and including flexible means joining said housings.

17. A tape dispenser according to claim 16 in which said flexible means comprises a flexible tape.

18. A multiple unit tape dispenser comprising:

a. a plurality of juxtaposed, generally hollow plastic housings each having one closed side and one side open sufficiently to permit insertion of a roll of tape within the hollow plastic housing, b. each housing having a front dispenser wall having a slot substantially across the width of said housing, said slot being dimensioned to permit withdrawal of tape longitudinally from a roll of tape within said housing, c. a tape support shelf extending outwardly from said front dispenser wall of each said housing adjacent said slot, said shelf being positioned to underlie a length of tape when withdrawn from said housing, d. a spindle within each said housing for mounting of a roll of tape within said housing, said spindle extending across the width of said housing, e. at least one pair of connection elements for each said housing for attaching one tape dispenser to an adjacent tape dispenser, said connection elements comprising an extension of said spindle protruding from one side of a housing and a corresponding extension-receptive socket in the adjacent housing, and f. an end plate shaped to cover the open side of an end one of said juxtaposed housings.

19. A multiple unit tape dispenser according to claim 18 including a pin protruding outwardly from one side of each said housing and a corresponding aperture formed in the other side of each said housing in axial alignment with said pin.

20. A tape dispenser according to claim 18 including a flexible tape hingedly joining said housings.

* * * * *